United States Patent [19]

Adsit

[11] Patent Number: 4,521,116

[45] Date of Patent: Jun. 4, 1985

[54] MIXING APPARATUS WITH REMOVABLE DRUM LINER

[75] Inventor: Gordon H. Adsit, Lake Wales, Fla.

[73] Assignee: Gordon W. Orthner, Tampa, Fla.

[21] Appl. No.: 616,121

[22] Filed: Jun. 1, 1984

[51] Int. Cl.[3] ..... B28C 5/18

[52] U.S. Cl. ..... 366/54; 220/410; 366/45; 366/57

[58] Field of Search ..... 366/54, 55, 56, 57, 366/58, 59, 62, 63, 45, 46, 47, 185; 494/45; 220/410

[56] References Cited

U.S. PATENT DOCUMENTS

| | | | |
|---|---|---|---|
| 1,055,950 | 3/1913 | Steel | 220/410 |
| 2,494,119 | 1/1950 | Essick | 366/45 |
| 2,573,296 | 10/1951 | Arant . | |
| 2,576,457 | 11/1951 | Henderson . | |
| 2,838,291 | 6/1958 | Peebles . | |
| 3,232,586 | 2/1966 | McClive | 366/55 |
| 3,424,440 | 1/1969 | Upham | 366/47 |
| 3,456,875 | 7/1969 | Hein | 494/45 |
| 3,760,972 | 9/1973 | McKirnan | 220/410 |
| 3,768,785 | 10/1973 | Susemihl . | |
| 4,430,084 | 2/1984 | Deaton | 220/410 |

*Primary Examiner*—Robert W. Jenkins

*Attorney, Agent, or Firm*—Duckworth, Allen, Dyer & Pettis

[57] ABSTRACT

Improved apparatus for mixing concrete or the like is described and includes a support frame, a rotational drive mounted to the frame, a drum liner support rotatably connected to the rotational drive and a drum liner connected to and supported by the drum liner support and comprising a container having one open end for receiving therewithin the material to be mixed.

8 Claims, 6 Drawing Figures

MIXING APPARATUS WITH REMOVABLE DRUM LINER

BACKGROUND OF THE INVENTION

This invention relates to improved apparatus for mixing concrete, epoxy, or the like. The invention is particularly applicable to apparatus for mixing materials that are difficult to clean from the mixing apparatus, although it may be used for mixing numerous types of materials.

Various types of prior art mixing apparatus are well known. These generally include a mixing drum fabricated of a suitable material, such as steel, that receives directly the materials to be mixed. However, the materials being mixed, whether concrete, epoxy, or other cementitious materials frequently present problems of cleaning the interior of the mixing drum. This is particularly a problem when mixing epoxy resin, such as when combining the resin with gravel for applications in decking and sidewalks. Cleaning of such materials may require burning or other drastic steps, some of which are destructive to the mixing apparatus or may violate governmental regulations.

SUMMARY OF THE INVENTION

In view of the disadvantages of the prior art, it is an object of this invention to provide mixing apparatus that is convenient to use and in which the interior of the mixing container may readily be renewed. It is a further object of this invention to provide such apparatus in which the mixing drum includes a removable liner. It is yet another object of this invention to provide such apparatus that is compact and relatively lightweight.

Briefly, the invention contemplates apparatus for mixing concrete or the like which includes a support frame, rotational drive apparatus mounted to the frame, a drum liner supporting device rotatably connected to the rotational drive apparatus, and a drum liner releasably connected to and supported by the drum liner supporting device and comprising a container having one end open for receiving therewithin the material to be mixed. In a preferred embodiment of the apparatus of this invention, the drum liner is formed of a substantially rigid synthetic resin and has formed integrally therewith a plurality of agitating elements.

DESCRIPTION OF THE DRAWINGS

The present invention will be discussed in detail with reference to the accompanying drawings in which.

DESCRIPTION OF A PREFERRED EMBODIMENT

Figure 1:
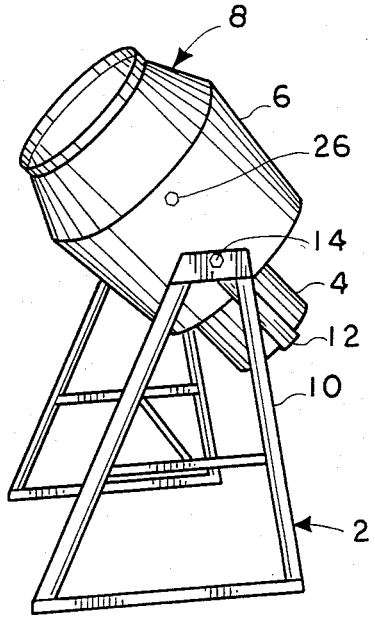
FIG. 1 is a perspective view of mixing apparatus according to the present invention.

A particulary preferred embodiment of the apparatus of this invention is illustrated in the figures, including the assembled view of FIG. 1. The apparatus comprises, essentially, a support frame generally indicated by reference number 2, rotational drive means 4 mounted to the frame 2, drum liner supporting mean 6 rotatably connected to the rotational drive means 4 and drum liner means, generally indicated by reference number 8, releasably connected to and supported by the drum liner supporting means 6.

The support frame 2 is of conventional construction that includes a base portion 10 fabricated of any suitable material, such as angle iron, with a drum supporting yoke 12 pivotally mounted thereto by suitable pivoting connection 14.

The rotational drive means 4 suitably may be mounted to the yoke 12 and may comprise any convenient drive mechanism such as an electric motor, gasoline engine, or hand crank. For the purposes of this embodiment the unit is illustrated as having a suitable electric motor as the rotational drive 4. The rotational drive 4 may be rotatably connected to the drum liner 8 in any conventional manner. This could include a shaft connection from a suitable gear box to determine the rotational speed, such as illustrated in the preferred embodiment, or the use of a bull gear and pinion, belt drive, or any other conventional drive arrangement.

Figure 2:
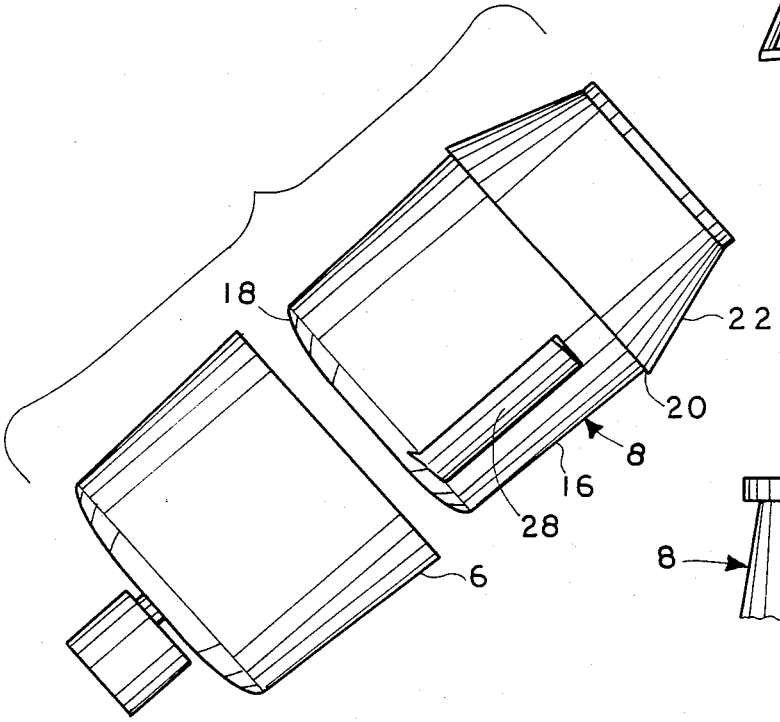
FIG. 2 is an exploded view of the drum liner and drum liner supporting means of this invention.
Figure 3:
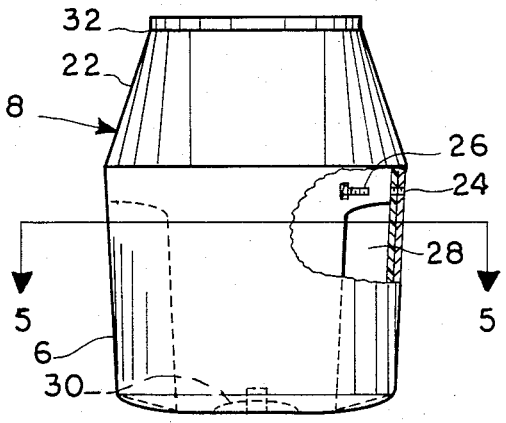
FIG. 3 is a side elevational view, partially in section, of the drum liner and drum liner supporting means of the apparatus of this invention.
Figure 6:
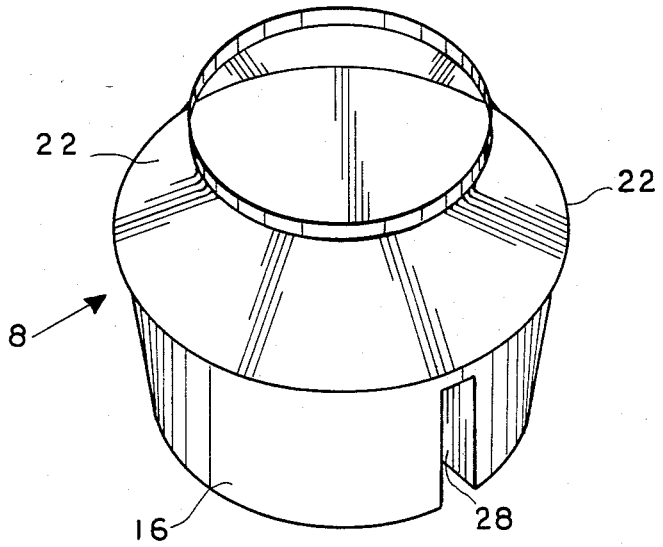
FIG. 6 is a perspective view of a preferred embodiment of the drum liner of the present invention.
Figure 5:
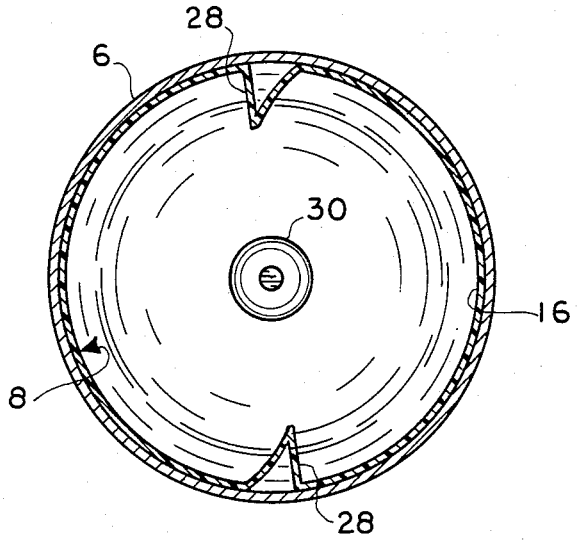
FIG. 5 is a top sectional view taken along lines 55 of FIG. 3.

The exploded view of FIG. 2 and the side elevation of FIG. 3 illustrate in greater detail the configuration of the mixing drum. As shown in FIG. 2, the drum liner supporting means 6 may suitably comprise a tub-like drum rotatably connected, through shafting or otherwise, to the drive means 4. While this drum liner supporting means 6 is shown as a tub-like arrangement in this preferred embodiment, it is to be understood that it could be of any suitable configuration, including an open framework, an arrangement of brackets, or the like, so long as it receives and supports the drum liner 8.

Drum liner 8 may be of any suitable configuration for releasable connection to and support by the supporting means 6. This drum liner could be formed of any suitable material, including metal or appropriate synthetic resins. In this particularly preferred embodiment, the liner 8 is illustrated as being formed of a substantially rigid synthetic resin, such as polyethylene or other high density polymer.

Although the actual construction of the drum liner 8 could be of numerous forms, the unit of this embodiment is illustrated as having a first portion 16 extending from the closed end 18 to the shoulder 20 and having a generally cylindrical configuration. This first portion 16 is received within the drum liner supporting means 6. The drum liner 8 further comprises a second portion 22 axially joined to the first portion 16, suitably at the shoulder 20 which defines the open end of the first portion. The second drum liner portion 22 has the configuration of a body of revolution tapering from a diameter approximating the diameter of the first portion 16 at the point where the first and second portions join, to a smaller diameter at the open end of that second portion, which is distal the first portion. This drum liner means 8 could suitably be formed either of two separate members joined together, by adhesives, welding, clamps or threaded fasteners, or may be formed, as illustrated herein, as a unitary liner.

When the liner 8 is inserted into the supporting means 6, it may suitably be releasably connected to that supporting means 6 in any conventional manner. For example, the supporting means may be provided with a hole 24 through the side wall thereof, through which a corresponding hole may be drilled through the liner 8. Then, a threaded fastener 26 may suitably be inserted through the hole, releasably joining the liner 8 to the supporting means 6 in a manner which will resist relative movement between them until that fastener is removed.

As shown most clearly in FIGS. 2, 3, 5 and 6, the liner 8 preferably is formed with at least one, and preferably two, agitating elements 28 forming a part thereof. Where the liner 8, or at least the first portion 16 thereof, is formed of a suitable synthetic resin, these agitating elements 28, which extend inwardly of the liner 8, may suitably be molded integrally with the liner. These agitating elements thus serve to agitate and stir the contents of the drum liner to be mixed when the drum liner is rotated by the supporting means and rotational drive. If necesssary, an appropriate relief 30 may be formed in the base of the liner 8 to clear the fasteners or other members comprising the attachment of the liner supporting means to the rotational drive.

Figure 4:
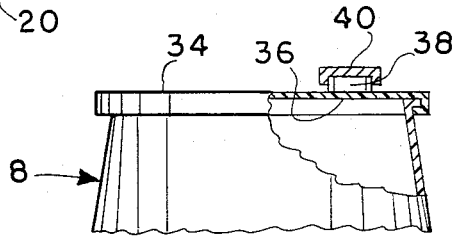
FIG. 4 is a fragmentary view, on an enlarged scale, of the upper portion of the apparatus of FIG. 3.

In a variation of this preferred embodiment, illustrated in the fragmentary view of FIG. 4 the open rim of the drum liner 8 is provided with a lip 32 over which a lid 34 may be fastened, as by snapping. By providing such a lip 32, or other suitable means for fastening the lid 34 to the open end of the drum liner 8, the drum liner 8 may comprise a closed container. As an additional feature, an aperture 36 may be provided through the lid with a spout 38 surrounding such aperture 36 and extending outwardly of the lid surface. This spout 38 may have an appropriate cap 40 removably covering the outer end of the spout, so that contents of the drum liner 8 may be poured through that spout. In this manner, the drum liner 8 may serve as a shipping container for such materials as epoxy resin or other materials for use with the mixing apparatus.

While the foregoing describes a preferred embodiment of the improved mixing apparatus of this invention, it is to be understood that the described embodiment is illustrative only of the principles of the invention and is not to be considered limitative thereof. Accordingly, because numerous variations and modifications of this apparatus, all within the scope of the invention, will readily occur to those skilled in the art, the invention is to be limited solely by the claims appended hereto.

What is claimed is:

1. Apparatus for mixing concrete or the like, comprising;

a support frame;

rotational drive means mounted to said frame;

liner supporting means rotatably connected to said rotational drive means; and drum liner means removably connected to and supported by said drum liner supporting means and comprising a container having a first axial portion of generally cylindrical configuration having one closed end and other open end and a second axial portion joined to said first portion at said open end thereof, said first portion having said closed end being received within said drum liner supporting means and said second portion remaining outside said drum liner supporting means and having the configuration of a body of revolution tapering from a diameter approximately the diameter of said first portion where said first portion and said second portion join to a smaller diameter at the end of said second portion distal said first portion, said second portion distal end being open.

2. The apparatus of claim 1 wherein said drum liner means is formed of a substantially rigid synthetic resin.

3. The apparatus of claim 1 wherein said drum liner means has formed integrally therewith at least one agitating element extending inwardly of said drum liner means and substantially parallel to the axis of said drum liner means.

4. The apparatus of claim 3 wherein said drum liner means has formed integrally therewith a plurality of said agitating elements.

5. The apparatus of claim 1 further comprising lid means for covering said container second portion open distal end.

6. The apparatus of claim 5 wherein said lid means is removably attached to said container.

7. The apparatus of claim 6 wherein said lid means further includes an aperture therethrough and spout means surrounding said aperture and extending outwardly of said lid means.

8. The apparatus of claim 7 further comprising cap means removably receivable over said spout means to close said spout means.

* * * * *

UNITED STATES PATENT AND TRADEMARK OFFICE

CERTIFICATE OF CORRECTION

PATENT NO. : 4,521,116

DATED : June 4, 1985

INVENTOR(S) : Gordon H. Adsit

It is certified that error appears in the above-identified patent and that said Letters Patent are hereby corrected as shown below:

column 4, claim 1, line 14, change "other" to

-- another --.

column 4, claim 1, line 21, change "approximately" to

-- approximating --.

Signed and Sealed this

*Seventeenth* Day of *September 1985*

[SEAL]

*Attest:*

DONALD J. QUIGG

*Attesting Officer*

*Commissioner of Patents and Trademarks—Designate*